US006910622B2

(12) United States Patent
Mark et al.

(10) Patent No.: US 6,910,622 B2
(45) Date of Patent: Jun. 28, 2005

(54) SUSPENDED FILE FOLDER

(75) Inventors: Wallace N. Mark, Hamilton (CA); Thomas W. Deans, Orangeville (CA)

(73) Assignee: Canadian Environmental Office Products Inc., Hamilton (CA)

( * ) Notice: Subject to any disclaimer, the term of this patent is extended or adjusted under 35 U.S.C. 154(b) by 2 days.

(21) Appl. No.: 10/274,981

(22) Filed: Oct. 22, 2002

(65) Prior Publication Data

US 2003/0089762 A1 May 15, 2003

Related U.S. Application Data

(60) Provisional application No. 60/330,437, filed on Oct. 22, 2001.

(51) Int. Cl.[7] ..... B65D 27/00
(52) U.S. Cl. ..... 229/67.2; 312/312
(58) Field of Search ..... 229/67.2; 312/184

(56) References Cited

U.S. PATENT DOCUMENTS 3,238,947 A * 3/1966 Churnick ..... 211/162
3,244,179 A * 4/1966 Porteous et al. ..... 211/162
3,746,180 A * 7/1973 Spiroch et al. ..... 211/113
3,971,502 A * 7/1976 Grundell ..... 229/122
4,053,057 A * 10/1977 Snowden ..... 211/126.13
4,181,381 A * 1/1980 St. Amand ..... 312/183
4,193,218 A * 3/1980 Mermelstein ..... 40/374
4,236,770 A * 12/1980 Moore et al. ..... 312/184
5,680,938 A * 10/1997 Rubinstein ..... 211/42
5,707,001 A 1/1998 Mark et al.
6,248,050 B1 * 6/2001 Boy ..... 493/213
6,332,285 B1 12/2001 Aaldenberg et al.

* cited by examiner

*Primary Examiner*—Jes F. Pascua
(74) *Attorney, Agent, or Firm*—Curtis B. Behmann; Borden Ladner Gervais LLP

(57) ABSTRACT

A suspended file folder assembly is made from thermoplastic material and uses a thermoplastic sheet folded along at least one score line to define a folder, which has a retaining portion at upper edges thereof. A support bar, having a cavity in a bottom portion thereof, mechanically engages with the retaining portion. The interlock between the retaining portion and the cavity of the support bar is weight bearing and serves to distribute the load of the folder along the length of the cavity of the support bar and the upper edge of the sheet. The support bars have notches therein for engagement with conventional suspension rails as well as at least one indentation for accommodating an index tab. A rotatable index tab, or clip tab, with a lower part that is complimentary in shape to the support bar and the attachable to the support bar is also provided.

14 Claims, 4 Drawing Sheets

SUSPENDED FILE FOLDER

This application claims the benefit of priority from U.S. patent application Ser. No. 60/330,437 filed on Oct. 22, 2001.

FIELD OF THE INVENTION

The present invention relates to suspended file folders and file folder assemblies, and relates particularly to folders and assemblies that are easily manufactured and have good strength characteristics.

BACKGROUND OF THE INVENTION

Suspended file folders are well known. The most common types are formed from a folded cardboard folder that is attached at its upper edges to metal support bars. The support bars project from either side of the folder to form hooks engageable with suspension rails of a filing drawer.

While such folders have achieved considerable commercial success, they have a variety of disadvantages or weaknesses, including some or all of the following:

a. The support bars tend to be susceptible to being permanently bent or otherwise misshapen. Bent or misshapen bars alter the distance between the hooks, potentially causing the file folders to fall away from the support bar. The bars typically are of metal of a thickness that causes them to bend easily and permanently when loaded with weight from files.

b. The metal support bars glide poorly on the metal suspension rails. Thus in some versions, separate plastic inserts attached to the metal support bars are employed.

c. The folders are subject to frequent crumpling or ripping, particularly at a medial fold at a bottom end thereof when in use, which must bear both weight and impact from inserted files or papers, and also along the side edges.

d. At the top of the folder, the cardboard tends to detach as a result of general wear, poor quality glue, insufficient glue, or poor manufacturing techniques. This is observed both in designs where the cardboard has been folded over the support bars and attached to itself, and in designs where the metal bar and the cardboard are glued or otherwise fastened to each other.

e. Similarly, the metal bars tend to rip through the cardboard at the top of the folder due to handling, which causes the edges of the metal bar to cut through the cardboard.

f. Recycling of the folders is inefficient, since it requires separating the cardboard portion from the metal portion. The presence of adhesives may make recycling more difficult. In practice, the folders are therefore not often recycled, and instead they are discarded into the waste stream, which is obviously undesirable.

g. Manufacture of the folders is not as efficient as it would be if the step of securing the folder to the support bar could be avoided.

Not all suspended file folders have all of the above problems, and indeed some designs have attempted to address some or all of these problems. U.S. Pat. No. 5,707,001 issued to Mark et al. on Jan. 13, 1998 teaches a suspended file folder made entirely from thermoplastic material, which makes it easy to manufacture and recycle. Two thermoplastic support bars are permanently fused one to each wall of the folder to provide strength and rigidity.

The support bars are on the inside or outside of the folder. In order to enhance rigidity and strength, the support bars in Mark et al. are preferably provided with ribs.

Despite the improvements in Mark et al., it has been found that folders produced as taught therein, even with the enhancements, are not sufficiently durable in many situations where the weight of the folder contents is significant. Therefore, there is a need for improvement such as that provided by the present invention.

SUMMARY OF THE INVENTION

It is an object of the present invention to obviate or mitigate at least one disadvantage of previous suspended file folders. It is particularly advantageous to provide an improvement with respect to the strength and/or load carrying capacity thereof, as well as the ease of manufacture thereof.

The invention provides a file folder assembly, which is made entirely from thermoplastic material. The assembly uses a thermoplastic sheet folded along at least one score line to define a folder. Two thermoplastic support bars are mechanically attached, one to each wall of the folder along the upper edges thereof. The thermoplastic sheet is fitted to a slot or cavity defined at a bottom end of the support bar, by way of a retaining portion provided at the upper edges of the sheet to keep the sheet mechanically attached to the support bars. The edges of the sheet are in fact load bearing.

The invention also provides a rigid thermoplastic index tab, or clip tab, made for attachment to the folder assembly. The index tab is designed such that it can be rotated in its original position on the support bar to change the angle of viewing of an indexing portion thereof for the viewer, without unseating the index tab from its attachment to the support bar.

According to an aspect of the present invention, there is provided a file folder assembly for suspension in a filing unit with two spaced-apart suspension rails. The file folder assembly comprises a sheet of thermoplastic polymer folded along at least one medial line to define a folder having opposing walls extending upwardly from said at least one medial line, each wall having an upper edge and two side edges, each of said walls comprising a retaining portion at the upper edge thereof. The file folder assembly also comprises two thermoplastic polymer support bars each having a pair of legs at a bottom portion thereof defining therebetween a channel terminating in a cavity for mechanically engaging with the retaining portion, the support bars having integral suspension portions extending laterally beyond the side edges adjacent the upper edge, the suspension portions having notches configured to accommodate said suspension rails, said support bars each having at least one indentation on a generally upper portion thereof for accepting an index tab.

The retaining portion can be a single continuous retaining component, which may extend along the entire length of the upper edge or along a portion thereof. The retaining portion can alternatively comprise a plurality of discontinuous retaining components positioned along a portion of the length of the upper edge.

With respect to the characteristics of the retaining portion, it preferably has a "T"-shaped cross-section, or an annular cross-section.

The support bar can have a single indentation at the top of an upper portion thereof, or a pair of indentations on either side of the upper portion thereof, or both. A portion of the cross-section of the support bar can be substantially greater in thickness than the sheet of thermoplastic polymer, the support bars each having a tapered lower portion which tapers downwardly from the portion of substantially greater thickness to substantially zero thickness flush with the sheet. In such a case, the lower portion can be straight tapered or tapered in a curved manner. The support bar is preferably generally ring-shaped, and can be elliptically shaped.

The file folder assembly preferably further comprises an index tab for attachment to the indentation in one of the support bars. The index tab comprises an upper indexing portion for displaying index information, and a lower attaching portion having two leg-like extensions for mechanically engaging with the upper portion of the support bar, allowing limited mechanical rotation of the index tab about the axis of the support bar to provide a wide range of viewing angles for the indexing portion while remaining engaged with the support bar.

The lower attaching portion of the index tab is preferably shaped in a manner that is complimentary to the shape of the support bar to which it is to mechanically attach. The index tab preferably has leg-like extensions comprising end portions that engage with the support bar so as to limit the degree of rotation of the index tab when it is mechanically rotated.

According to another aspect of the present invention, there is provided a thermoplastic polymer support bar for use with a file folder for suspension in a filing unit with two spaced-apart suspension rails, the folder having a retaining portion at an upper edge thereof and having side edges. The support bar comprises a pair of legs at a bottom portion thereof defining therebetween a channel terminating in a cavity for mechanically engaging with the retaining portion, the support bar having integral suspension portions extending laterally beyond the side edges adjacent the upper edges, the suspension portions having notches configured to accommodate the suspension rails, the support bars each having at least one indentation on a generally upper portion thereof for accepting an index tab.

According to a further aspect of the present invention, there is provided an index tab for attachment to a hanging file folder, the hanging file folder having a support bar with an indentation in an upper portion thereof for receiving the index tab. The index tab comprises an upper indexing portion for displaying index information, and a lower attaching portion having two leg-like extensions for mechanically engaging with the upper portion of the support bar, allowing limited mechanical rotation of the index tab about the axis of the support bar to provide a wide range of viewing angles for the indexing portion while remaining engaged with the support bar.

The lower attaching portion of the index tab is preferably shaped in a manner that is complimentary to the shape of the support bar to which it is to mechanically attach. The index tab preferably has leg-like extensions comprising end portions that engage with the support bar so as to limit the degree of rotation of the index tab when it is mechanically rotated.

The use of a thermoplastic material in order to produce a folder assembly according to embodiments of the present invention is preferable. A unitary sheet is used such that a material failure would be required for the product to fail. Such a design avoids having secondary failure points due to delamination or bonding failure. Conventional paper folders require an abutment, which entails some sort of lamination, whether another piece is added or the sheet is rolled or folded. The stress on the lamination or fold caused by a supported load would cause the lamination or fold to fail (delamination).

Other aspects and features of the present invention will become apparent to those ordinarily skilled in the art upon review of the following description of specific embodiments of the invention in conjunction with the accompanying figures.

BRIEF DESCRIPTION OF THE DRAWINGS

Embodiments of the present invention will now be described, by way of example only, with reference to the attached figures, wherein.

DETAILED DESCRIPTION

Generally, the present invention provides a suspended file folder assembly made from thermoplastic material that uses a thermoplastic sheet folded along at least one score line to define a folder, which has a retaining portion at upper edges thereof. A support bar, having a cavity in a bottom portion thereof, mechanically engages with the retaining portion. The interlock between the retaining portion and the cavity of the support bar is weight bearing and serves to distribute the load of the folder along the length of the cavity of the support bar and the upper edge of the sheet. The support bars have notches therein for engagement with conventional suspension rails as well as at least one indentation for accommodating an index tab. A rotatable index tab, or clip tab, with a lower part that is complimentary in shape to the support bar and the attachable to the support bar is also provided.

Figure 1:
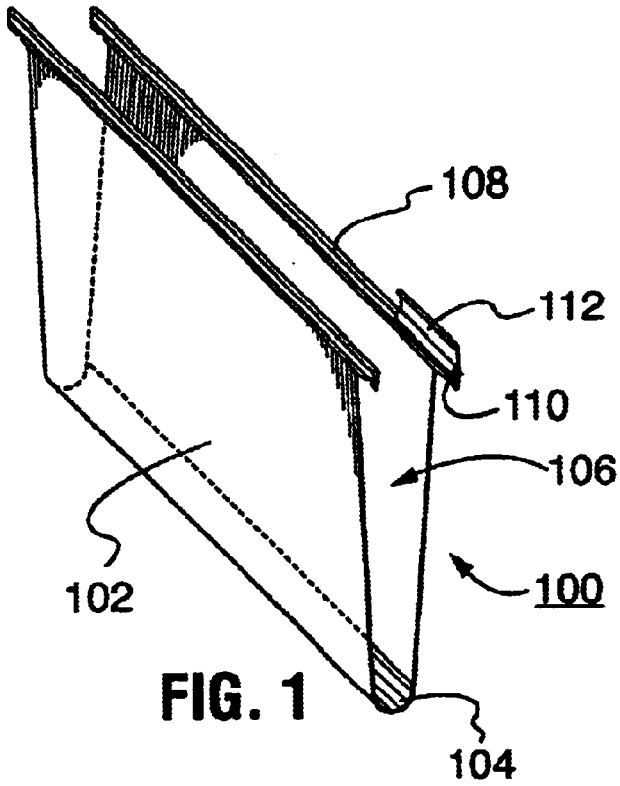
FIG. 1 illustrates a perspective view of a file folder assembly according to the invention.

FIG. 1 illustrates a perspective view of a file folder assembly according to an embodiment of the present invention. A file folder assembly 100 is preferably made entirely of thermoplastic material. The assembly 100 uses a thermoplastic sheet 102 folded along one or more score lines 104 to define a folder 106. The upper edges of the folder 106 each comprise a retaining portion (not shown) for fitting into a cavity of a support bar 108 and mechanically engaging therewith. The support bars 108 have integral suspension portions extending laterally beyond the side edges adjacent the upper edge and have notches 110 therein, preferably generally U-shaped and downwardly-opening, configured to accommodate conventional suspension rails (not shown), boxes or crates known in the art. The support bars 108 are provided with at least one indentation for accepting an index tab, or clip tab, 112. The thermoplastic support bars 108 are mechanically attached one to each wall of the folder 106 along the upper edges thereof, to provide the required degree of strength and rigidity.

Figure 2:
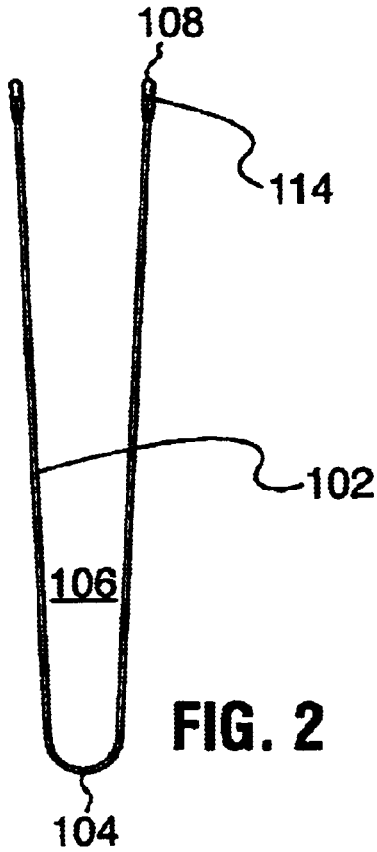
FIG. 2 illustrates an end view of the file folder assembly shown in FIG. 1.

FIG. 2 illustrates an end view of the file folder assembly of FIG. 1. The view in FIG. 2 provides a clearer illustration of the engagement of the retaining portion at the upper edges of the folder 106 with the support bars 108. Various embodiments of a folder, and the retaining portion provided thereon, will now be described.

Figure 3A:
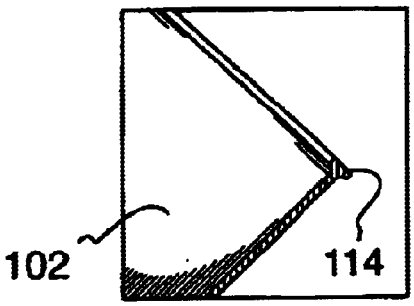
FIG. 3A illustrates a detail perspective view of an upper edge of a first embodiment of a file folder according to the invention.
Figure 3B:
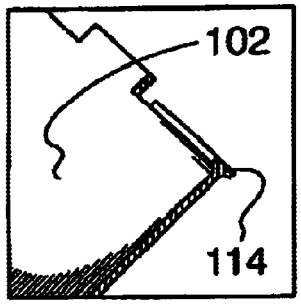
FIG. 3B illustrates a detail perspective view of an upper edge of a second embodiment of a file folder according to the invention.

FIG. 3A to FIG. 3D illustrate detailed perspective views of an upper edge of various embodiments of a file folder according to the invention. In FIG. 3A, the retaining portion 114 is illustrated as having a "T"-shape in a cross section thereof. The embodiment in FIG. 3A comprises retaining portion 114, comprising a single continuous retaining portion, in a T-shape cross section extending along the entire length of the upper edge of the file folder 106. FIG. 3B illustrates an alternative embodiment in which the retaining portion 114 is provided along a portion of the upper edge of the folder 106, and not its entire length. This embodiment provides the security of the T-shaped retaining portion, with cost savings in that material is not required for the retaining portion 114 along the entire length of the upper edge of the folder 106.

Figure 3C:
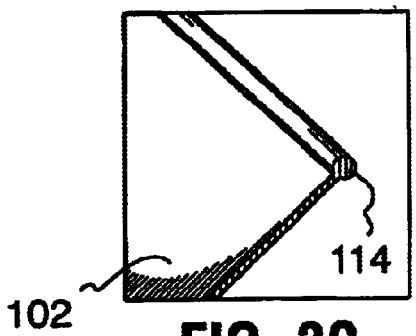
FIG. 3C illustrates a detail perspective view of an upper edge of a third embodiment of a file folder according to the invention.
Figure 3D:
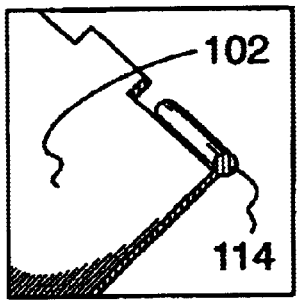
FIG. 3D illustrates a detail perspective view of an upper edge of a fourth embodiment of a file folder according to the invention.

FIG. 3C illustrates another embodiment in which the retaining portion 114 has a generally annular or circular cross section, which is preferably symmetrical around the axis of the sheet 102. FIG. 3D illustrates a further embodiment in which the retaining portion 114 has a circular or annular cross section and is provided only along a portion of the upper edge of the folder 106, similar to the situation in FIG. 3B.

The retaining portion 114 is preferably in either a T-cross section, or of annular, or circular, shape. However, the retaining portion 114 may be of any shape as long as it is functional and load bearing. Also, the retaining portion can alternatively comprise a single continuous retaining component that does not extend the entire length of the upper edge. It will be appreciated that although in FIG. 3B and FIG. 3D one retaining component of the retaining portion 114 is illustrated, any number of such discontinuous retaining components provided along the top of the folder 106 can be used to make up the retaining portion 114. The choice of whether the retaining portion 114 comprises a single continuous retaining component or one or more discontinuous retaining components extending along the entire length of the folder 106 may be made for economic, stress or load bearing reasons.

Figure 4:
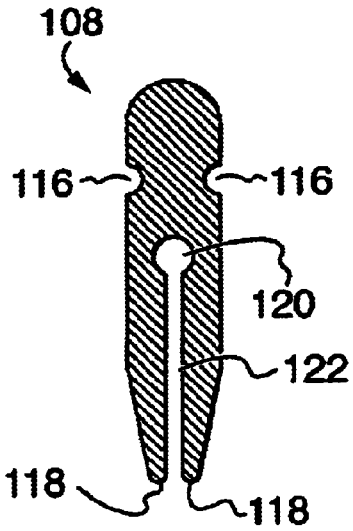
FIG. 4 illustrates a cross-sectional view of a first embodiment of a support bar according to the invention.

FIG. 4 illustrates a cross-sectional view of a first embodiment of a support bar according to the invention. Two thermoplastic support bars 108 are mechanically attached one to each wall of the folder along the upper edges thereof to provide the required degree of strength and rigidity. The support bars are preferably generally ring shaped and symmetrical, with an example of such a shape being elongated such that it is generally elliptical, or oval shaped.

As shown in FIG. 4, an upper, or top, portion of the support bar 108 is preferably rounded to provide a high degree of load bearing capability. The top of the support bar can be made in other shapes if a lesser degree of loading bearing capability is sufficient, such as in a case where new plastic material is developed that provides sufficient strength and rigidity using a less optimal design.

The support bar 108 is provided with at least one indentation to accommodate an index tab, also known as a clip tab or sliding tab. These indentations are functional rather than structural. In FIG. 4, indentations 116 are preferably provided on the outer edge of either side of the upper portion of the support bar 108. If the support bar has a total height of h, these indentations 116 are preferably positioned at a distance h/4 from the top of the support bar to accommodate an index tab 112 on the upper portion of the support bar. The indentations are preferably rounded, but may be made in any shape functional for holding an index tab.

The support bars are shaped with two legs 118 extending to form a lower portion thereof. The lower portion of the support bar, i.e. each of the legs 118, is preferably curved or straight-tapered on an outer surface thereof to become flush with the thermoplastic sheet 102 when attached. The tapering allows for the easy removal of the folder contents. The support bars appear to have been "cored" out narrowly from the bottom to a larger cavity 120. The cavity 120, rounded in the illustration, can be any shape that is able to accommodate the retaining portion 114 of the thermoplastic sheet. The cavity 120 is preferably larger than a channel 122 leading to it, to accomplish mechanical engagement of the folder 106 in the support bar 108.

The retaining portion 114 and the cavity 120 of the support bar 108 act to mechanically engage each other such that the sheet can not be pulled away or separated from the support bar 108. This locking arrangement is employed so as to increase the strength and load carrying capacity of the folder. The fact that the two portions of the locking arrangement appear modular is but a function of the design. In use, the retaining portion 114 and support bar 108 are not intended to be separated. The interlock between the retaining portion and the cavity of the support bar is weight bearing and serves to distribute the load of the folder along the length of the cavity of the support bar and the upper edge of the sheet.

Figure 5:
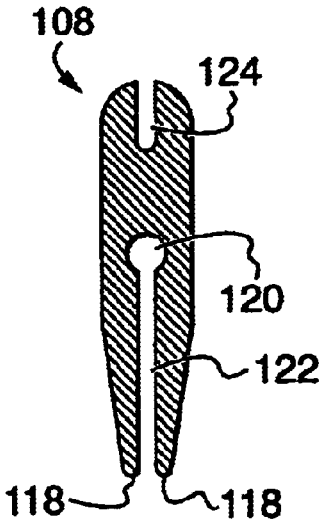
FIG. 5 illustrates a cross-sectional view of a second embodiment of a support bar according to the invention.

FIG. 5 illustrates a cross-sectional view of a second embodiment of a support bar according to the invention. In this embodiment, the non-structural indentations 116 are replaced by a top indentation 124. In this manner, the support bar 108 can accommodate an index tab 112 of a different design than that accommodated in the embodiment shown in FIG. 4.

Figure 6:
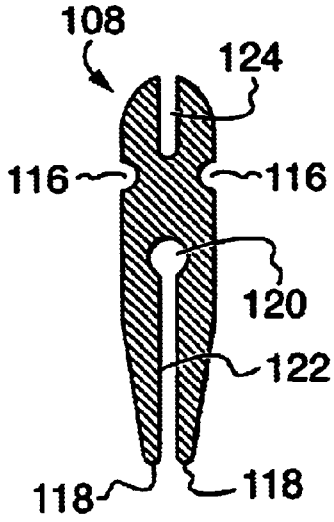
FIG. 6 illustrates a cross-sectional view of another embodiment of a support bar according to the present invention.

FIG. 6 illustrates another embodiment of a support bar according to the present invention. In this embodiment both the indentations 116 and the top indentation 124 are provided. This allows for the same support bar to be used with any one of, or both, distinct types of index tabs.

Figure 7A:
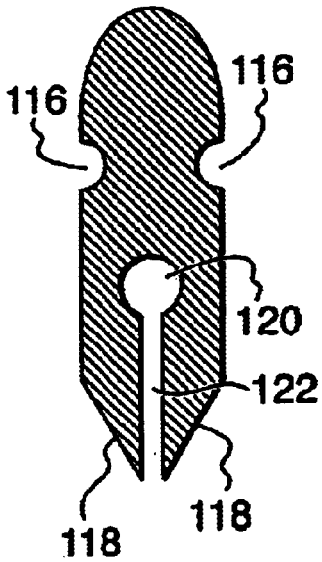
FIGS. 7A, 7B, 8A and 8B illustrate alternative embodiments of the shaping of legs of a support bar according to the present invention.
Figure 7B:
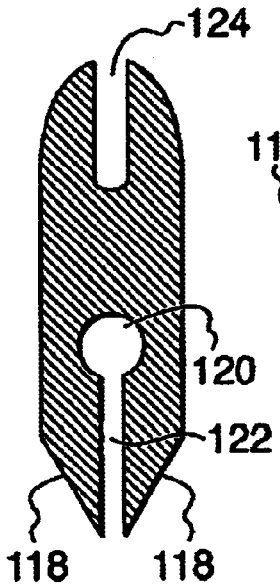
Figure 8A:
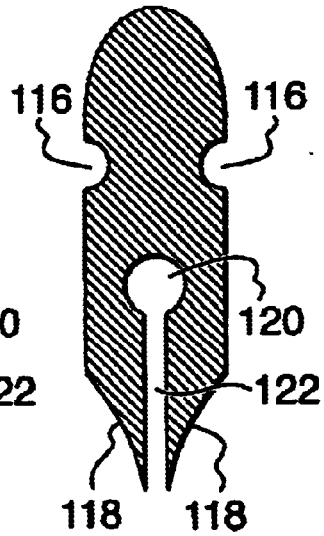
Figure 8B:
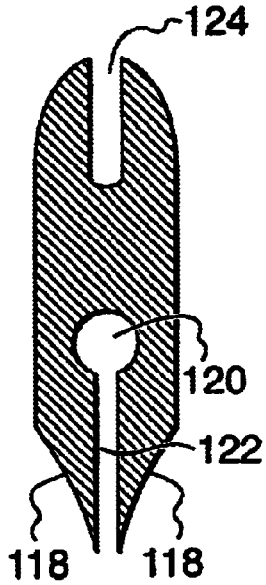

FIG. 7 and FIG. 8 illustrate alternative embodiments wherein the shaping, or tapering, of the legs 118 of the support bar 108 is modified. In FIG. 7A, the legs 118 in the lower portion of the support bar are straight-tapered and the support bar includes the indentations 116. In FIG. 7B, the legs 118 are also straight-tapered, but the support bar is one in which only a top indentation 124 is provided for accommodation of an index tab. FIG. 8A and FIG. 8B illustrate embodiments in which the legs 118 are tapered in a curved manner, with support bars similar to those shown in FIG. 7A and FIG. 7B, respectively. These embodiments shown in FIG. 7 and FIG. 8 illustrate examples of different tapering that may be used so as to facilitate the easy removal of folder contents without hitting the support bars and possibly dislodging or damaging them, as well as avoiding damage to the folder contents.

Figure 9:
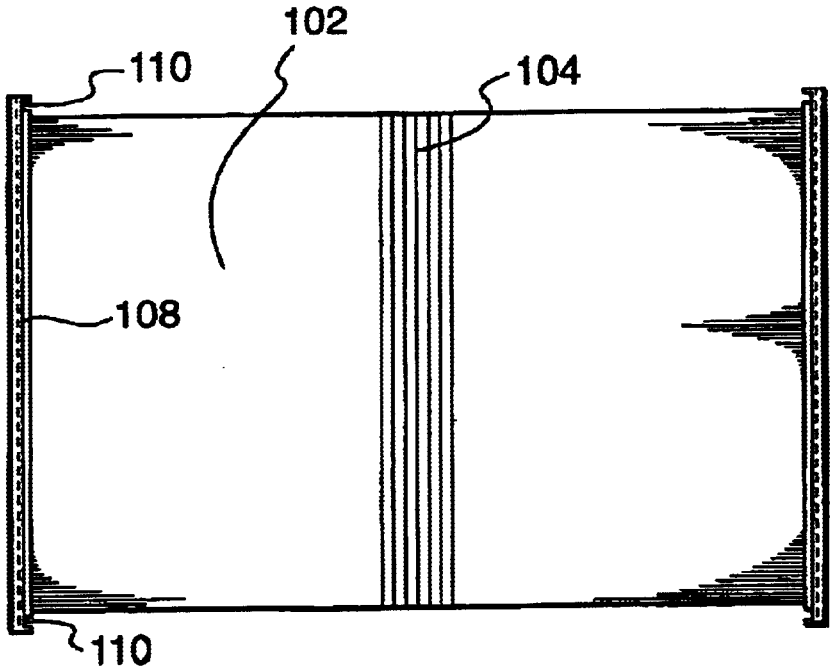
FIG. 9 illustrates a plan view of a folder assembly according to embodiment of the present invention.

FIG. 9 illustrates a plan view of a folder assembly according to an embodiment of the present invention. This plan view facilitates identification of the elements such as sheet 102, score lines 104, support rail 108, and notches 110.

Preferably, there are two of the score lines 104 at the bottom of the folder, so that the folder is somewhat U-shaped rather than V-shaped, to provide greater wear resistance by reducing the angle at each score. Additional score lines may be provided as well, if desired, particularly to accommodate thicker files or more papers.

Another aspect of the present invention provides an index tab, such as a plastic clip tab or sliding indexing tab, preferably made of a rigid thermoplastic polymer for mechanical attachment to a support bar of a hanging file folder, such as one of those described above in relation to embodiments of the invention.

Figure 10:
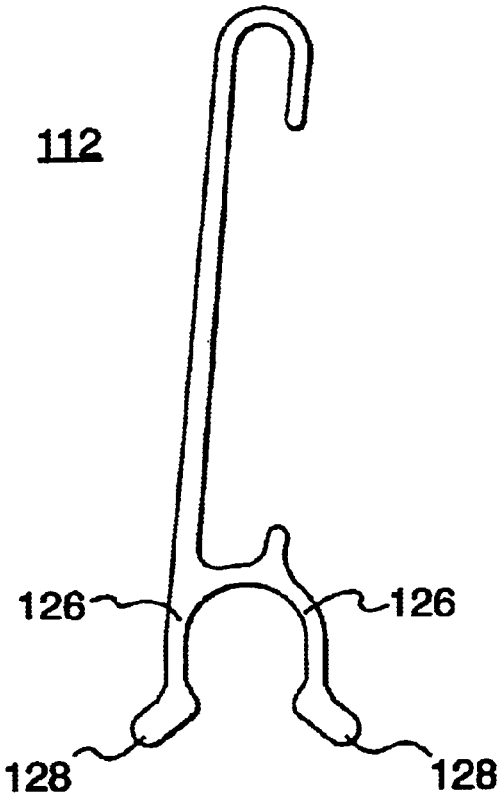
FIG. 10 illustrates a side view of a index tab according to an embodiment of the present invention.

FIG. 10 illustrates a side view of an index tab 112 according to an aspect of the present invention. An upper indexing portion of the index tab 112 provides an area for information to be displayed. A lower attaching portion of the index tab 112 is specifically formed to a shape that is complimentary to the shape of the support bar portion of the hanging folder 106 to which it is to mechanically attach. The lower or attaching portion of the clip has two leg-like extensions 126 that are preferably similar in length, but can be of differing length, to allow for controlled angular displacement or degree of rotation of the index tab 112. The two legs 126 are curved to conform with and grasp the support bar 108. The two leg-like extensions also conform to the indentations of the support bar 108.

The feet or end portions 128 of the leg-like extensions 126 prevent flexing of the index tab 112. They also act as a stop to control the degree of rotation of the index tab 112. The end portions, or feet, 128 engage with the support bar so as to limit the degree of rotation of the index tab when it is mechanically rotated. The index tab and support bar arrangement will now be described in more detail with reference to FIG. 11.

Figure 11:
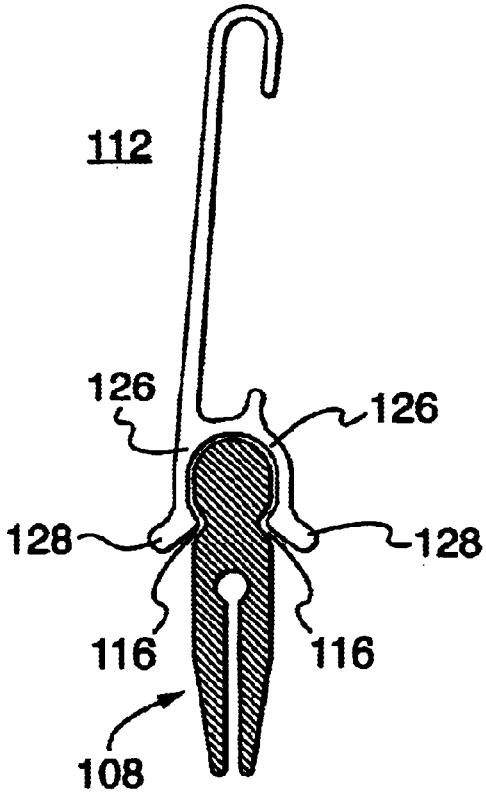
FIG. 11 illustrates a side view of a index tab seated on a support bar (shown in cross-section) according to an embodiment of the present invention.

FIG. 11 illustrates a side view of an index tab 112 according to an embodiment of the present invention seated on a support bar 108 (shown in cross-section) of a hanging file folder. The indentations 116 are functional since they allow the index tab 112 to grip the support bar 108 and rotate about the axis of the support bar. The index tab 112 is not fixed in one particular rigid position, but is free to be mechanically rotated in a limited path about the axis of the support bar 108, so as to allow for viewing of the index tab at multiple angles, without dislodging it.

The path of movement of the index tab 112 on the support bar 108 is such that it does not cause one or both of the legs 126 to flex away from the index tab 112 and be released from its seated, or engaged, position. The intent of providing secure rotatable engagement of the index tab 112 in the support bar 108 is to render the index tab positionable, i.e. movable but not removable. Due to this secure rotatable engagement, the index tab can also be used to remove the file by pulling it to lift it from the filing system.

Design of the index tab such that it can be mechanically rotated increases the range of angles from which the index tab, and any information contained thereon, can be easily viewed. Arrangements for placing information on such a index tab are known to those of skill in the art. For example, the index tab can have a face portion and a label-carrying slot defined behind the face portion, in which a label can be placed. As another example, an adhesive label can be affixed on the face portion.

The use of a thermoplastic material in order to produce a folder assembly according to embodiments of the present invention is preferable. A unitary sheet is used such that a material failure would be required for the product to fail. Such a design avoids having secondary failure points such as delamination or bonding failure.

The material used to form the file folder is preferably a thermoplastic polymer. It is preferred that the thermoplastic polymer be a melt-formable polymer, for ease of fabrication e.g. by melt extrusion of the polymer in a sheet. Excess polymer can also be recycled and re-extruded into a sheet.

The polymer in the sheet used to form the folder should have substantial stiffness, but still be sufficiently flexible to permit insertion of files into the folder. Sufficient stiffness is required at the top of the folder i.e. in the area used to suspend the file folders, referred to herein as upper edges having integral projecting end portions. The polymer used to form the support bars, in particular, should have properties so as to provide sufficient stiffness and strength for the support bars to be load bearing i.e. be substantially rigid but still have some flexibility. It is to be understood that this may be accomplished by selection of the thermoplastic material, but addition of reinforcing agents to a thermoplastic material similar to that used for the sheet is likely to be more conducive and amenable to recycling. In addition, the polymer needs to be capable of forming folds. The folds need to have significant wear resistance and strength for continued use of the folder.

For thermoplastic materials, the thickness of the sheet used to form the body of the folder preferably should be at least 5 mils (0.005 inches), and preferably 10–20 mils, 12–15 mils being the likely optimum. However, the thickness will depend on the particular thermoplastic polymer selected, and the strength and stiffness properties of that thermoplastic material, as well as the size of the folder being formed. The thermoplastic sheet used to form the folder will be preferably of uniform thickness.

The sheet and support bars can be formed from the same thermoplastic material, which facilitates recycling. The same thermoplastic material can also be used for the index tab. However, the polymer used to form the support bars may contain reinforcing agents, e.g. conventional fillers such as talc, mica, glass, etc.

The above-described embodiments of the present invention are intended to be examples only. Alterations, modifications and variations may be effected to the particular embodiments by those of skill in the art without departing from the scope of the invention, which is defined solely by the claims appended hereto.

What is claimed is:

1. A file folder assembly for suspension in a filing unit with two spaced-apart suspension rails, said file folder assembly comprising:

a sheet of thermoplastic polymer folded along at least one medial line to define a folder having opposing walls extending upwardly from said at least one medial line, each wall having an upper edge and two side edges, each of said walls comprising a retaining portion at the upper edge thereof;

two symmetrical thermoplastic polymer support bars each having a pair of legs at a bottom portion thereof defining therebetween a channel terminating in a cavity for mechanically locking with said retaining portion, the support bars having integral suspension portions extending laterally beyond the side edges adjacent the upper edge, the suspension portions having notches configured to accommodate said suspension rails, said support bars each having a continuous indentation on a generally upper portion thereof for accepting an index tab, the indentation being greater in size than a portion of the index tab to be accepted, allowing for rotation of the index tab through the indentation; and an index tab for attachment to the identation in one of the support bars, the index tab comprising:

an upper indexing portion for displaying index information; and a lower attaching portion having two leg-like extensions for mechanically engaging with the upper portion of the support bar, allowing limited mechanical rotation of the index tab about the axis of the support bar to provide a wide range of viewing angles for the indexing portion while remaining engaged with the support bar, the leg-like extensions including end portions that engage with the support bar so as to limit the degree of rotation of the type index tab when it is mechanically rotated through the indentation.

2. A file folder assembly according to claim 1 wherein the retaining portion comprises a single continuous retaining component.

3. A file folder assembly according to claim 1 wherein the retaining portion extends along the entire length of the upper edge.

4. A file folder assembly according to claim 1 wherein the retaining portion comprises a plurality of discontinuous retaining components positioned along a portion of the length of the upper edge.

5. A file folder assembly according to claim 1 wherein the retaining portion has a "T"-shaped cross-section.

6. A file folder assembly according to claim 1 wherein the retaining portion has an annular cross-section.

7. A file folder assembly according to claim 1 wherein the continuous indentation includes a single continuous top indentation at the top of an upper portion of the support bar, the top indentation being greater in size than a part of the index tab to be accepted, allowing for rotation of the index tab through the top indentation.

8. A file folder assembly according to claim 1 wherein the continuous indentation includes a pair of side indentations on either side of the upper portion of the support bar, the side indentations being greater in size than a part of the index tab to be accepted, allowing for rotation of the index tab through the side indentations.

9. A file folder assembly according to claim 1 wherein at least a portion of the cross-section of the support bar is substantially greater in thickness than the sheet of thermoplastic polymer, the support bars each having a tapered lower portion which tapers downwardly from the portion of substantially greater thickness to substantially zero thicknesses flush with the sheet.

10. A file folder assembly according to claim 9 wherein the lower portion is straight tapered.

11. A file folder assembly according to claim 9 wherein the lower portion is tapered in a curved manner.

12. A file folder assembly according to claim 1 wherein the support bar is generally ring-shaped.

13. A file folder assembly according to claim 1 wherein the support bar is elliptically shaped.

14. A file folder assembly according to claim 1 wherein the lower attaching portion of the index tab is shaped in a manner that is complimentary to the shape of the support bar to which it is to mechanically attach.

* * * * *